United States Patent [19]

Rabinovich

[11] Patent Number: 4,572,255

[45] Date of Patent: Feb. 25, 1986

[54] LIQUID DISPENSING NOZZLE WITH A PUMP PRESSURE RESPONSIVE AUTOMATIC SHUT-OFF MECHANISM

[75] Inventor: Evsey Rabinovich, Erie, Pa.

[73] Assignees: Alton Richards, Rockwood, Tenn.; Paul D. Carmack, Tipp City, Ohio

[21] Appl. No.: 603,519

[22] Filed: Apr. 24, 1984

[51] Int. Cl.[4] ..... B65B 3/28

[52] U.S. Cl. ..... 141/217; 137/463; 222/14; 222/59

[58] Field of Search ..... 141/192, 198, 206–229, 141/392; 137/463; 222/3, 4, 14, 59, 55, 395, 396

[56] References Cited

U.S. PATENT DOCUMENTS

| | | | |
|---|---|---|---|
| 1,990,741 | 2/1935 | Marvel | 137/463 |
| 4,331,187 | 5/1982 | Trygg | 141/217 |
| 4,497,350 | 2/1985 | Guertin | 141/225 |

*Primary Examiner*—Houston S. Bell, Jr.
*Attorney, Agent, or Firm*—Pitts and Brittian

[57] ABSTRACT

An improved liquid dispensing nozzle (10) for dispensing a liquid such as fuel, from a dispensing pump. The improved dispensing nozzle comprises a body (12) defining an internal passageway (13) provided with an inlet port (14) for releasably connecting the nozzle (10) in fluid communication with a dispensing pump and an outlet port (16) for carrying a spout assembly (17) for selectively directing the flow of liquid from the nozzle (10). A main valve (18) is mounted within the body (12) between the inlet port (14) and the outlet port (16) and is provided with an operating lever (32) for selectively opening the main valve (18) to allow liquid to be discharged from the nozzle (10). The nozzle (10) further comprises ball-latch mechanism (25) for selectively disabling the operating lever (32) in order to close, or prohibit the opening of, the main valve (18) and further comprises first automatic shut-off mechanism (34) for selectively releasing the ball-latch mechanism (25) so as to disable the operating lever (32) when the supply pressure from the dispensing pump falls below a preselected value.

12 Claims, 2 Drawing Figures

LIQUID DISPENSING NOZZLE WITH A PUMP PRESSURE RESPONSIVE AUTOMATIC SHUT-OFF MECHANISM

DESCRIPTION

1. Technical Field

This invention relates to an improved liquid dispensing nozzle for dispensing a fuel or other liquid. In this particular invention, the nozzle includes a first automatic shut-off means for automatically closing the main valve of the nozzle when pressure from the dispensing pump falls below a preselected value.

2. Background Art

Automatic shut-off nozzles of the general type used on fuel pumps in filling stations are old in the art. These nozzles are normally provided with hold-open catches for holding the operating lever in an open position and an automatic shut-off means for shutting off the flow of fuel from the nozzle when the tank level reaches the discharge end of the nozzle. The hold-open catch feature and the automatic shut-off means allow the operator to leave the nozzle unattended during the filling operation without fear that the tank will overflow should it become full while the nozzle is unattended. However, problems have arisen with the use of such hold-open catches and automatic shut-off mechanisms at pre-pay self-service filling stations.

At the usual pre-pay self-service station, the dispensing pump is preset to dispense a preselected volume of fuel upon payment by the customer/operator of the appropriate fee, with the dispensing pump being set to automatically shut-off when the preselected amount has been dispensed. If the dispensing nozzle used is provided with a hold-open catch and an automatic shut-off mechanism, it is common for the customer/operator to set the hold-open catch and leave the nozzle unattended until the pump stops dispensing fuel. It will be appreciated that when the flow of fuel is terminated automatically at the dispensing pump, the operating lever may remain in an open position. Thus, the nozzle is returned to the pump in an open position, and the next time the dispensing pump is turned on, fuel is dispensed through the open nozzle whether the customer/operator is prepared to dispense or not. This often results in fuel pouring from the nozzle while it is still positioned on the dispensing pump or pouring from the open nozzle before the customer/operator has had an opportunity to put the nozzle in the desired dispensing position. In response to the dangers presented by the use of such hold-open catches at pre-pay self-service stations, many such stations have removed the hold-open catches from the nozzle, obviating, to some extent, the dangers presented, but denying the customer/operator the convenience of being able to leave the nozzle unattended.

Further, even in pre-pay filling stations where the hold-open catches have been removed, the danger of inadvertent dispensing of fuel still exists. For example, the nozzle operating lever can become blocked in an open position, accidentially held open on the dispensing pump locking mechanism or intentionally wired open.

Therefore, it is an object of the present invention to provide an improved liquid dispensing nozzle which automatically closes the main valve of the nozzle when dispensing pump pressure falls below a preselected value.

It is another object of the present invention to provide an improved liquid dispensing nozzle which cannot be reset to an open position until dispensing pump pressure reaches a preselected value and the operating lever of the nozzle is properly manipulated.

It is yet another object of the present invention to provide an improved liquid dispensing nozzle which carries a hold-open catch and an automatic shut-off means for closing the main valve of the nozzle when the fuel level of the tank being filled reaches the discharge end of the nozzle.

Still another object of the present invention is to provide an improved liquid dispensing nozzle which can be safely used at pre-pay self-service filling stations.

Another object of the present invention is to provide an improved liquid dispensing nozzle which is inexpensive to manufacture and inexpensive to maintain.

DISCLOSURE OF THE INVENTION

Other objects and advantages will be accomplished by the present invention which provides an improved liquid dispensing nozzle for dispensing a liquid such as fuel, from a dispensing pump. The improved nozzle of the present invention comprises a body defining an internal passageway provided with an inlet port for releasably connecting the nozzle in fluid communication with a dispensing pump and an outlet port carrying a spout assembly for selectively directing the flow of liquid from the nozzle. A main valve is mounted within the body between the inlet port and outlet port and is provided with an operating lever for selectively opening the main valve to allow liquid to be dispensed from the nozzle. The nozzle further comprises latch means for selectively disabling the operating lever in order to close, or prohibit the opening of, the main valve, and further comprises first automatic shut-off means for selectively releasing the latch means so as to disable the operating lever when the supply pressure from the dispensing pump falls below a preselected value. In one embodiment, the nozzle further comprises a hold-open catch for selectively holding the operating lever in an open position and comprises a further automatic shut-off means for closing the main valve when the liquid or fuel dispensed reaches the discharge end of the spout assembly.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
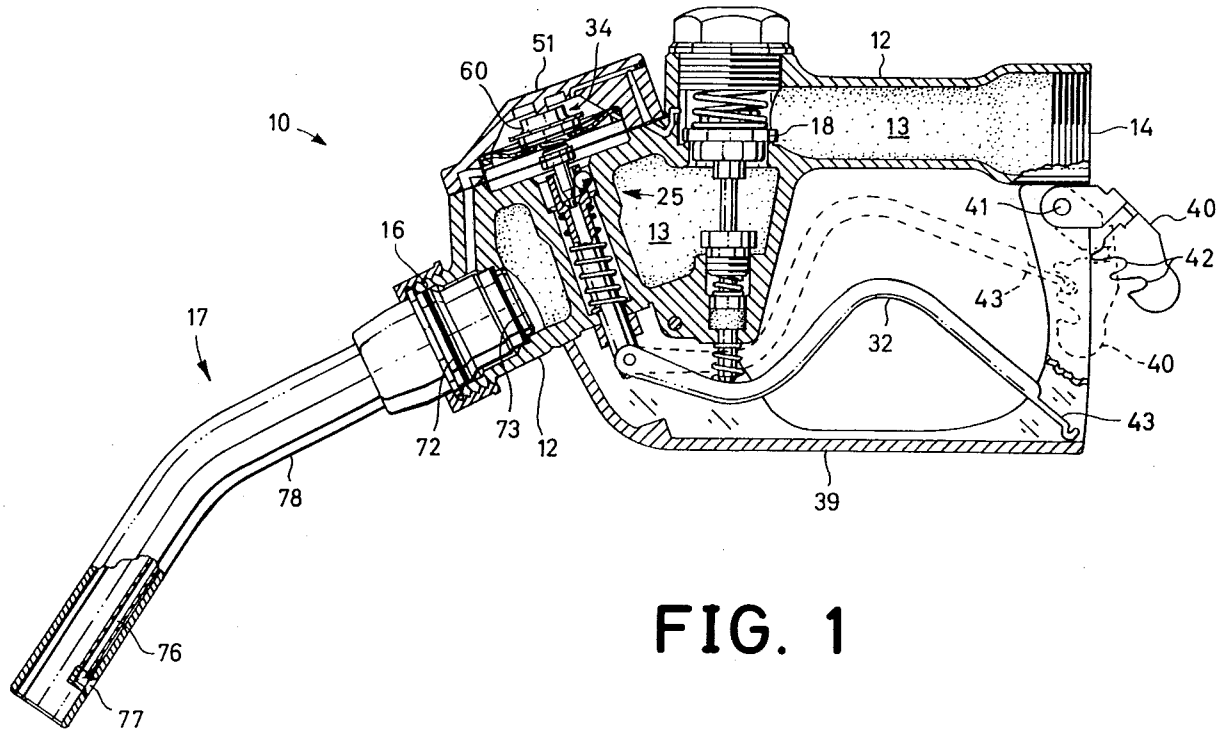
FIG. 1 illustrates a side elevation, partially in section, of the improved nozzle of the present invention.

An improved liquid dispensing nozzle for dispensing fuel or other liquids incorporating various features of the present invention is illustrated generally at 10 in the Figures. The nozzle 10 comprises a body 12 defining an internal passageway 13. Internal passageway 13 is provided with an inlet port 14 for threadably receiving a fuel supply hose (not shown) and an outlet port 16 for threadably receiving a spout assembly 17.

The nozzle 10 further comprises a main valve 18 mounted within the body 12 between the inlet port 14 and the outlet port 16 for selectively terminating the flow of liquid through the passageway 13. More specifically, the main valve 18 comprises a valve cap 20 provided with an annular seal member 21. The valve cap 20 is downwardly biased by main valve spring 22 such that seal member 21 releasably engages the annular valve seat 23 of the body 12 so as to selectively close the passageway 13 to the flow of fuel or other liquid.

To facilitate the selective opening of main valve 18, a main valve poppet 24 is provided, the poppet 24 being mounted at the upper end portion of actuator stem 26 such that the upper portion of the poppet 24 is slidably received in the valve cap 20. The lower end portion 27 of the stem 26 is received through the hole 28 in the body 12 such that a preselected portion of the stem 26 is exterior to the body 12 of nozzle 10. The fuel impervious integrity of the passageway 13 is insured by a suitable sealant 29 and a downwardly spring biased seal washer 30 slidably mounted on the stem 26. Further, a journalling sleeve 31 is threadably received in the body 12 for slidably receiving the stem 26 to insure the proper coaxial alignment of the poppet 24 with the valve cap 20, and to serve as an adjustable bracing member for the spring biasing of seal washer 30.

With the poppet 24 and the stem 26 thusly mounted, the main valve 18 is selectively opened by the manipulation of operating lever 32. The lever 32 is pivotally mounted at a forward end portion 33 to the latch means 25 (discussed in detail below) at a selectively fixed pivot point 36. Thus, when the pivot point 36 is in the fixed position illustrated in FIG. 1, the lever 32 can be pivoted in the direction of arrow 37 so as to contact actuator stem 26 and force the poppet 24 and the valve 20 in an upward direction to open the valve 18. When lever 32 is released, the downward biasing provided by valve spring 22 causes the main valve 18 to close once again. It will also be noted that a spring member 38 is provided to further bias the lever 32 toward a closed position. Further, as illustrated in FIG. 1, a guard member 39 is provided to protect against the inadvertent pivoting of the operating lever 32 and to protect the hand of the operator of the nozzle 10.

Further, as illustrated in FIG. 1, the nozzle 10 is provided with a hold-open catch 40 pivotally mounted with rearward pivot bolt 41, the bolt 41 also serving to secure the rearward portion of guard member 39 to the body 12. The catch 40 is provided with a pair of notches 42 for releasably engaging the outboard end portion 43 of lever 32 such that the main valve 18 can be maintained in an open position while unattended.

Figure 2:
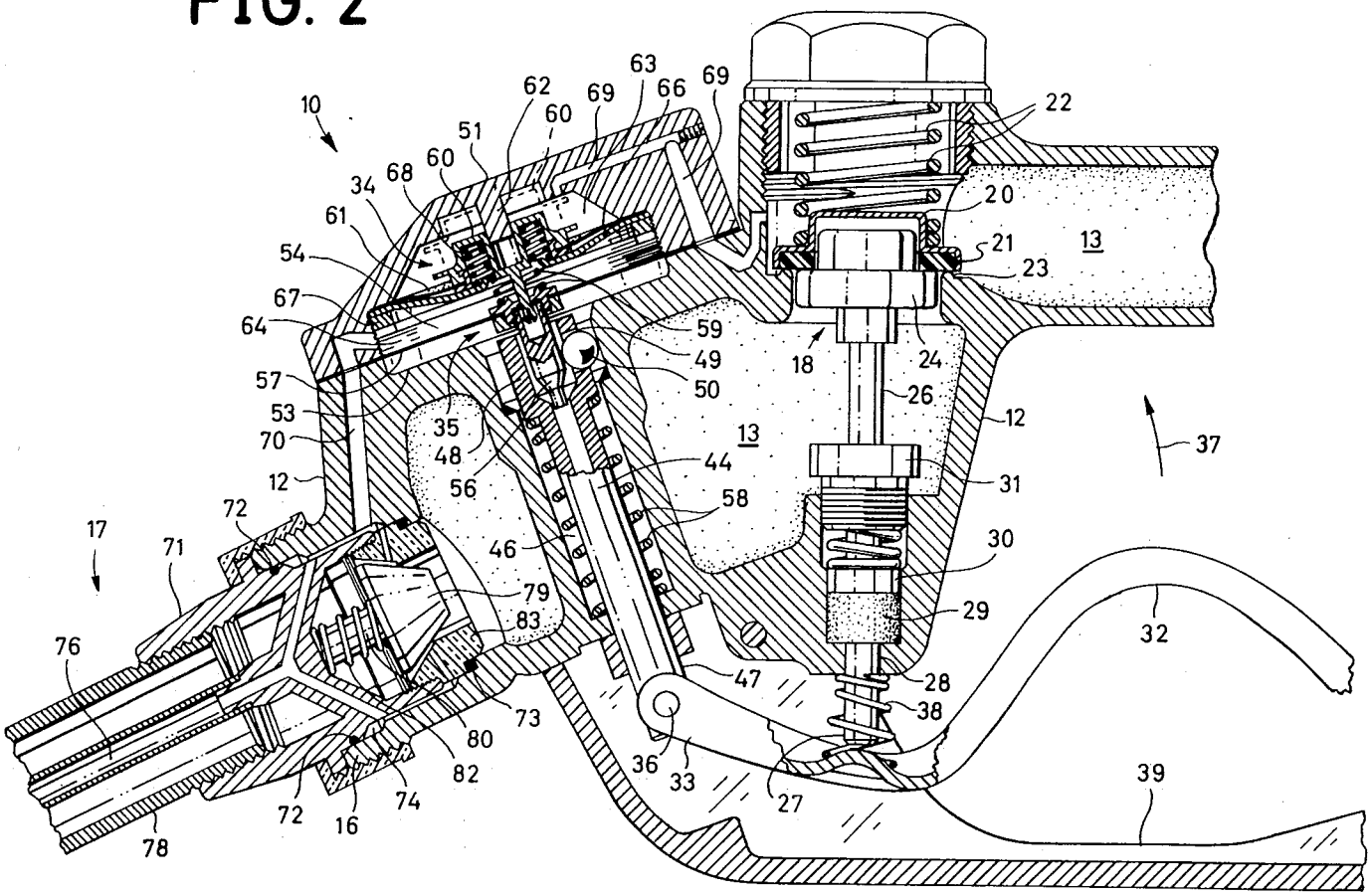
FIG. 2 illustrates a side elevation, partially in section, of the first and further automatic shut-off means of the improved nozzle of the present invention.

The nozzle 10 also comprises latch means 25 for selectively disabling the operating lever 32 in order to close main valve 18. The latch means 35 comprises a latch plunger 44 slidably mounted within the plunger housing 46, the housing 46 being integrally formed with the body 12. The plunger 44 is provided with a lower end portion 47 which pivotally engages the operating lever 32 at selectively fixed pivot point 36. The plunger 44 further comprises an upper end portion defining a latch pin receptor cup 48 for slidably receiving a latch pin 56. Further, the receptor cup 48 is provided with three sidewall openings 49 (only one such opening 49 being visible in the illustrated embodiment of FIGS. 1 and 2) for rotatably receiving three balls 50.

As is indicated above, the latch pin 56 is slidably received in the latch pin receptor cup 48. It will be appreciated that when the latch pin 56 is positioned within the receptor cup 48, the balls 50 are forced outwardly, and as long as the latch pin 56 remains in the receptor cup 48, those portions of the balls 50 extending beyond the exterior diameter of the plunger 44 prohibit the plunger 44 from moving downwardly within the housing 46. Thus, the pivot point 36 remains fixed, such that the pivoting of the operating lever 32 opens main valve 18. However, if the latch pin 56 is removed from the receptor cup 48, the balls 50 are allowed to withdraw into the receptor cup 48 and no longer serve to prohibit the downward movement of plunger 44. Thus, if operating lever 32 is depressed, the plunger 44 moves downwardly and the lever 32, being denied a fixed pivot point, will not serve to open main valve 18. It will be further noted that spring member 58 is provided in order to upwardly bias the plunger 44 such that it will return to the locked, upwardly disposed position when the lever 32 is at rest.

In order to facilitate the safe use of the hold-open catch 40, the nozzle 10 is provided with first automatic shut-off means 34 for closing the main valve 18 when supply pressure from the dispensing pump falls below a preselected value, and provided with further automatic shut-off means 35 for closing the main valve 18 when the fuel or liquid in the tank being filled reaches the level of the discharge end of the nozzle 10. In this regard, a cap member 51, releasably secured to the body 12 with suitable cap screws (not shown), is provided. The cap member 51 together with annular recess 53 provided in the body 12 thus serve to define a chamber 54 above the plunger housing 46, the chamber 54 serving to partially house the automatic shut-off means 34 and 35.

Automatic shut-off means 34 comprises a diaphragm plunger 60 secured to a pressure diaphragm 61, the diaphragm plunger 60 being slidably received on a guide stem 62 of the cap member 51 so as to be coaxially aligned with the latch pin 56. The diaphragm plunger 60 and the pressure diaphragm 61 serve as a fluid impervious barrier transversely dividing the upper portion of the chamber 54 so as to define a pressure chamber 63. Preferably the pressure diaphragm 61 is fabricated of a flexible or resilient material so as to be moveably responsive to changes in relative pressure on opposite sides of the pressure diaphragm 61. Given this resiliency in the pressure diaphragm 61, the diaphragm plunger 60 is also moveably responsive to such pressure changes with the downward motion of the diaphragm plunger 60 being limited by the retainer disk 66, the retainer disk 66 and the pressure diaphragm 61 being releasably secured within the cap member 51 with the diaphragm nut 67. It will be noted that a pressure spring 68 is provided for upwardly biasing the diaphragm plunger 60 such that in absence of sufficient pressure within the pressure chamber 63 to overcome such upward bias the diaphragm plunger 60 will remain in the upward position illustrated with broken lines at 60' of FIG. 2. Further, when the diaphragm plunger 60 is in an upward position, the plunger 60 will also hold the latch pin 56 in an upward position such that the latch plunger 44 is free to move downwardly in the housing 46 and the main valve 18 cannot be opened.

In order to provide the fluid pressure necessary to move the diaphragm plunger 62 to the downward position such that main valve 18 can be opened, a pressure conduit 69 is provided establishing fluid communications between the pressure chamber 63 and the passageway 13 on the liquid supply side of the main valve 18. Thus, given the pressure conduit 69, when liquid is supplied to the nozzle 10 under sufficient pressure, the pressure diaphragm 61 and the diaphragm plunger 60 are forced downwardly by such pressure allowing the latch pin 56 to be received in the receptor cup 48. Therefore, the main valve 18 of the nozzle 10 cannot be opened unless supply pressure to the nozzle 10 reaches a preselected pounds per square inch (PSI).

Since the main valve 18 cannot be opened without dispensing pump pressure, it will be appreciated that even should the operating lever 32 be secured in the open position, when the dispensing pump is turned off the operating lever 32 is disabled due to the latch pin 56 being held out of receptor cup 48. Further, if the operating lever 32 is still in the open position when dispensing pump pressure is restored, the lever 32 will remain disabled until the lever 32 is released to a closed position such that plunger 44 will travel upward to receive the latch pin 56. Therefore, before the nozzle 10 will dispense liquid, there must not only be dispensing pressure, but the operating lever 32 must be reset to a closed position. Thus, the nozzle 10 can be safely used at a pre-pay self-service station without fear that the nozzle will be in an open position when the dispensing pump is turned on.

It will also be noted that the diaphragm plunger 60, when in an upward position, closes the conduct 69. Whereas the plunger 60 does not fluid imperviously seal the conduit 69, in the case of a rupture of the pressure diaphragm 61, the plunger 60 will limit the leakage of fuel or liquid to an acceptable level, and in the case of flamable liquids, to a level conforming to governmental regulations.

With regard to further automatic shut-off means 35, the latch pin 56, which is coaxially aligned with and slidably received in the latch pin receptor cup 48, is secured to a vacuum diaphragm 57, the diaphragm 57 being mounted between the cap member 51 and the body 12. Thus, the vacuum diaphragm 57 serves as a gasket between the cap member 51 and the body 12, and together with the latch pin 56 forms a fluid impervious barrier transversely dividing the chamber 54 so as to define a vacuum chamber 64. In the preferred embodiment, the vacuum diaphragm 57 is fabricated of a resilient or flexible material so as to be moveably responsive to changes in the relative pressure on opposite sides of the diaphragm 57. Also, a vacuum spring 59 is provided in order to bias latch pin 48 downwardly to a closed or latched position.

Continuing with regard to the operation of the automatic shut-off assembly 35, the removal of latch pin 56 from the receptor cup 48 in order to close main valve 18 when the tank being filled is full is accomplished through the selective generation of a partial vacuum in the vacuum chamber 64 such that vacuum diaphragm 57 collapses inwardly with respect to the vacuum chamber 64 thus lifting the latch pin 56. The vacuum necessary to effect such automatic closing of the main valve 18 is generated by the spout assembly 17. Accordingly, fluid communications between the vacuum chamber 64 and the spout assembly 17 is provided by a vacuum conduit 70.

The spout assembly 17 comprises a base member 71 which is received in and threadably secured to outlet port 16 of the body 12. It will be noted that the base member 71 is provided with a forward and rearward seal member 72 and 73, respectively, such that a circumferential chamber 74 is defined between the base member 71 and the outlet port 16. Further, the spout assembly 17 is provided with a venting conduit 76 establishing fluid communication between the circumferential chamber 74 and a venting port 77, (see FIG. 1), the port 77 being located proximate the discharge or outboard end portion of spout 78. The spout assembly also comprises a poppet valve 79 slidably mounted on a valve shaft 80, the poppet valve 79 being rearwardly spring biased with spring member 82 to be releasably received in a popped valve seat 83.

Therefore, it will be appreciated that when main valve 18 is in an open position and liquid under pressure is forced through outlet port 16, the poppet valve 79 is pushed forward allowing the fuel or liquid to escape around the valve 79 creating a venturi effect between poppet valve 79 and valve seat 83. Of course, so long as the venting conduit 76 remains open, the vacuum chamber 64 will remain vented to the surrounding air pressure and no vacuum will be generated. However, when the tank being filled becomes full to the extent that the liquid covers the venting port 77, the venturi effect results in a partial vacuum being generated in the vacuum chamber 64 resultantly lifting the latch pin 56 so as to close the main valve 18.

With respect to the generation of the partial vacuum in vacuum chamber 64, it should be noted that in many dispensing nozzles presently on the market and in use, the poppet valve for generating the venturi effect is incorporated into the main valve of the nozzle. However, such alternate construction is totally compatable with the first automatic shut-off means 34, with only a change in the location of the vacuum conduit 70 being necessary.

From the above description, it will be appreciated that the nozzle 10 will not dispense liquid until there is dispensing pressure from the dispensing pump, and thus the nozzle 10 provides an efficient and safe means for dispensing fuel at a pre-pay self-service filling station, without sacrificing the convenience of a hold-open catch. Further, the nozzle 10 is suitable for dispensing various liquids and is not limited to use only at pre-pay filling stations.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. An improved liquid dispensing nozzle for dispensing a liquid from a dispensing pump, said nozzle comprising:

a body defining an internal passageway, said passageway being provided with an inlet port for being releasably connected in fluid communication to said dispensing pump, and an outlet port, said body being further provided with a cap member releasably mounted on said body whereby said cap member and said body define an automatic shut-off chamber;

a main valve mounted within said body between said inlet port and said outlet port for selectively opening and closing said passageway to the flow of said liquid, said main valve being normally biased to a closed position, said main valve being provided with an operating lever for selectively opening said main valve to the flow of said liquid;

a spout assembly secured to said outlet port of said body for selectively directing the flow of said liquid from said nozzle;

latch means for selectively closing and prohibiting the opening of said main valve; and first automatic shut-off means for selectively releasing said latch means so as to selectively close and prohibit the opening of said main valve when supply pressure from said dispensing pump falls below a preselected value, said first automatic shut-off means comprising a pressure diaphragm transversely dividing said automatic shut-off chamber so as to define a pressure chamber, said pressure diaphragm being movably responsive to changes in pressure within said pressure chamber, said pressure diaphragm engaging said latch means such that preselected movement of said pressure diaphragm in response to pressure within said pressure chamber reaching such preselected value actuates said latch means such that said main valve can be opened, said first automatic shut-off means further comprising a pressure conduit having a first end opening into said pressure chamber and a second end opening into said passageway between said main valve and said inlet port, whereby pumping pressure generated by said dispensing pump, is communicated to said pressure chamber.

2. The improved liquid dispensing nozzle of claim 1 wherein said nozzle further comprises further automatic shut-off means for closing said main valve when said liquid reaches the discharge end of said spout assembly.

3. The improved liquid dispensing nozzle of claim 1 wherein said nozzle is provided with a hold-open catch for selectively maintaining said operating lever in an open position.

4. The improved liquid dispensing nozzle of claim 1 wherein said latch means comprises a latch plunger slidably mounted within a plunger housing defined by said body, said latch plunger being provided with a lower end portion which pivotally engages said operating lever, and being further provided with an upper end portion defining a latch pin receptor cup, said receptor cup being provided with a plurality of side wall openings each rotatably receiving a latch ball, said latch means further comprising a latch pin for being slidably received within said receptor cup.

5. The improved liquid dispensing nozzle of claim 1 wherein said pressure diaphragm is provided with a diaphragm plunger for engaging said latch means, and wherein said diaphragm plunger is provided with spring biasing means for biasing said diphragm plunger to a preselected position whereby said diaphragm plunger maintains said latch means in an open position in absence of pressure within said pressure chamber reaching such preselected value.

6. The improved liquid dispensing nozzle of claim 5 wherein said first automatic shut-off means further comprises a retainer disk for restricting the downward movement of said diaphragm plunger.

7. The improved liquid dispensing nozzle of claim 5 wherein said cap member is provided with a guide stem for slidably receiving said diaphragm plunger so as to insure the proper alignment of said diaphragm plunger.

8. The improved liquid dispensing nozzle of claim 5 wherein said diaphragm plunger covers said first end of said pressure conduit when said diaphragm plunger is in an upward position such that the flow of any said liquid through said pressure conduit is at least partially restricted.

9. The improved liquid dispensing nozzle of claim 2 wherein said further automatic shut-off means comprises:

a vacuum diaphragm mounted between said cap member and said body transversely dividing said automatic shut-off chamber so as to define a vacuum chamber, said vacuum diaphragm being secured to said latch means such that preselected movement of said diaphragm plunger releases said latch means so as to close and prohibit the opening of said main valve, a poppet valve provided with a poppet valve seat for generating a venturi effect, a vacuum conduit for connecting in fluid communication said vacuum chamber with said poppet valve seat, and a venting conduit for connecting in fluid communication said vacuum chamber with the discharge end of said spout assembly.

10. The improved liquid dispensing nozzle of claim 1 wherein said latch assembly comprises a latch plunger slidably mounted within said body, said latch plunger being provided with a lower end portion for pivotally engaging said operating lever and an upper end portion defining a ball latch, said ball latch comprising a receptor cup and comprising a latch pin for being selectively received and secured in said receptor cup, and wherein said diaphragm plunger engages said latch pin such that said preselected movement of said diaphragm plunger removes said latch pin from said receptor cup so as to release said latch means.

11. In an improved liquid dispensing nozzle comprising a body defining an internal passageway, said passageway being provided with an inlet port and an outlet port, and a main valve mounted within said body between said inlet port and said outlet port for selectively opening and closing said passageway to the flow of said liquid; said main valve being provided with an operating lever for selectively opening said main valve and latch means for selectively closing and prohibiting the opening of said main valve, said nozzle being further provided with a spout assembly secured to said outlet port, said improvement comprising first automatic shut-off means for selectively releasing said latch means so as to close and prohibit the opening of said main valve when supply pressure to said nozzle falls below a preselected value, said first automatic shut-off means comprising:

a cap member releasably mounted on said body, said cap member and said body defining an automatic shut-off chamber, an upwardly biased diaphragm plunger secured to a pressure diaphragm, said diaphragm plunger and said pressure diaphragm transversely dividing said automatic shut-off chamber so as to define a pressure chamber, said diaphragm plunger engaging said latch means such that preselected movement of said diaphragm plunger releases said latch means so as to close and prohibit the opening of said main valve, and a pressure conduit provided within said cap member and said body, said pressure conduit having a first end opening into said pressure chamber and a second end opening into said passageway between said main valve and said inlet port.

12. A liquid dispensing nozzle for dispensing a liquid from a dispensing pump, said nozzle comprising:

a body defining an internal passageway, said passageway being provided with an inlet port for being releasably connected in fluid communication to said dispensing pump, and an outlet port, and further defining a plunger housing with in said body, said body being further provided with a cap member releasably mounted on said body, said cap member and said body defining a pressure chamber above said plunger housing;

a main valve mounted within said body between said inlet port and said outlet port for selectively opening and closing said passageway to the flow of said liquid, said main valve being normally biased to a closed position, said main valve being provided with an operating lever for selectively opening said main valve to the flow of said liquid;

a spout assembly secured to said outlet port of said body for selectively directing the flow of said liquid from said nozzle;

latch means for selectively closing and prohibiting the opening of said main valve, said latch means comprising a latch plunger slidably mounted within said plunger housing, said latch plunger being provided with a lower end portion for pivotally engages said operating lever, and being further provided with an upper end portion defining a latch pin receptor cup, said receptor cup being provided with a plurality of side wall openings each rotatably receiving a ball-latch, said latch means further comprising a latch pin for being slidably received in said receptor cup, whereby insertion of said latch pin into said receptor cup locks said latch means so as to allow the opening of said main valve;

first automatic shut-off means for selectively releasing said latch means so as to close and prohibit the opening of said main valve when supply pressure from said dispensing pump falls below a preselected value, said first automatic shut-off means comprising a diaphragm plunger secured to a pressure diaphragm, said diaphragm plunger and said pressure diaphragm transversly dividing said automatic shut-off chamber so as to define a pressure chamber, said diaphragm plunger engaging said latch pin such that selected movement of said diaphragm plunger away from said latch plunger removes said latch pin from said receptor cup and selected movement of said diaphragm plunger toward said latch plunger inserts said latch pin into said receptor cup, said diaphragm plunger being provided with spring biasing means for biasing said diaphragm plunger away from said latch plunger, said first automatic shut-off means further comprising a pressure conduit provided within said cap member and said body, said pressure conduit having a first end portion opening into said pressure chamber and a second end opening into said passageway between said main valve and said inlet port; and further automatic shut-off means for closing said main valve when said liquid reaches the discharge end of said spout assembly, said further automatic shut-off means comprising a vacuum diaphragm mounted within said automatic shut-off chamber and transversely dividing said automatic shut-off chamber so as to define a vacuum chamber, said vacuum diaphragm being secured to said latch pin such that preselected movement of said vacuum diaphragm releases said latch means so as to selectively close and prohibit the opening of said main valve, said further automatic shut-off means further comprising a poppet valve provided with a poppet valve seat for generating a venturi effect, a vacuum conduit for connecting in fluid communication said vacuum chamber with said poppet valve seat, and a venting conduit for connecting in fluid communication said vacuum chamber with said discharge end of said spout assembly.

* * * * *